US006476722B1

(12) United States Patent
Bidone

(10) Patent No.: US 6,476,722 B1
(45) Date of Patent: Nov. 5, 2002

(54) THERMOGRAPHIC SYSTEM TO CHECK AND PREVENT FIRES IN A VEHICLE

(75) Inventor: Alessandro Bidone, Volpedo (IT)

(73) Assignee: SAI Servizi Aerei Industriali S.r.l., Milan (IT)

( * ) Notice: Subject to any disclaimer, the term of this patent is extended or adjusted under 35 U.S.C. 154(b) by 0 days.

(21) Appl. No.: 09/569,948

(22) Filed: May 12, 2000

(30) Foreign Application Priority Data

May 14, 1999 (IT) ..... MI99A1065

(51) Int. Cl.[7] ..... G08B 19/02
(52) U.S. Cl. ..... 340/584; 340/578
(58) Field of Search ..... 340/584, 600, 340/578, 449, 425.5, 438, 439, 870.16, 870.17

(56) References Cited

U.S. PATENT DOCUMENTS

| | | | | | |
|---|---|---|---|---|---|
| 4,149,159 | A | * | 4/1979 | Datwyler et al. | 340/587 |
| 4,323,211 | A | * | 4/1982 | Bambara et al. | 246/169 |
| 4,659,043 | A | * | 4/1987 | Gallagher | 246/169 |
| 4,878,761 | A | * | 11/1989 | Duhrkoop | 374/124 |
| 5,153,722 | A | * | 10/1992 | Goedeke et al. | 358/108 |
| 5,173,692 | A | * | 12/1992 | Shapiro et al. | 340/943 |
| 5,187,322 | A | * | 2/1993 | Schloss et al. | 102/427 |
| 5,331,311 | A | * | 7/1994 | Doctor | 340/463 |
| 5,486,811 | A | * | 1/1996 | Wehrle et al. | 340/522 |
| 5,528,234 | A | * | 6/1996 | Mani et al. | 340/933 |
| 5,537,110 | A | * | 7/1996 | Iida et al. | 340/942 |
| 5,546,188 | A | * | 8/1996 | Wangler et al. | 356/376 |
| 5,717,390 | A | * | 2/1998 | Hasselbring | 340/933 |
| 5,793,491 | A | * | 8/1998 | Wangler et al. | 356/376 |

FOREIGN PATENT DOCUMENTS

| | | | |
|---|---|---|---|
| DE | 4402612 | 8/1995 | G07C/11/00 |
| EP | 0400607 | 12/1990 | G08B/13/194 |
| EP | 0822526 | 2/1998 | G08B/13/196 |
| JP | 10088996 | 4/1998 | |
| WO | WO9607167 | 3/1996 | G08G/1/00 |
| WO | WO9735433 | 9/1997 | H04N/7/18 |

* cited by examiner

*Primary Examiner*—Jeffery Hofsass
*Assistant Examiner*—Son Tang
(74) *Attorney, Agent, or Firm*—Abelman, Frayne & Schwab

(57) ABSTRACT

The thermographic system to check and prevent fires in a vehicle including at least a plurality of sensors held up by an arch structure and apt to detect the temperature of as many points of the vehicle as the number of sensors and a logic control unit connected to the above mentioned sensors, generating at least an alarm signal if the temperature detected by at least one of the sensors exceeds a pre-established value, which changes (or can change) according to the point of the vehicle checked by the sensor that detected the anomalous temperature. if the thermographic system is placed near a fixed/obligatory way, further sensors fitted into the ground allow to keep under control even the lower part of the vehicle.

1 Claim, 3 Drawing Sheets

THERMOGRAPHIC SYSTEM TO CHECK AND PREVENT FIRES IN A VEHICLE

FIELD OF THE INVENTION

The invention consists in a thermographic system to check and prevent the risks arising from a fortuitous fire of a road or rail vehicle (and/or its load) and comprising at least a plurality of sensors held up by an arch structure and apt to detect the temperature of as many parts of the vehicle as the number of sensors (with special attention to the points which are considered dangerous such as brakes, engine, etc) and a logic control unit connected to the above mentioned sensors generating at least an alarm signal (an optical one and/or a visual one) if the temperature detected by at least one of the sensors exceeds a pre-established value which changes (or can change) according to the point of the vehicle checked by the sensor that detected the anomalous temperature.

If the thermographic system is placed near a fixed way (such as a tollgate or the entrance of a station or of a storehouse) further sensors fitted into the ground allow to check even the lower part of the vehicle.

BACKGROUND OF THE INVENTION

The fire of a vehicle (a road one or a rail one) and of the possible carried load is (or can be) a considerable source of danger not only for its driver and its passengers but also for people who are going along the stretch of road (or railway) where there is the fired vehicle.

This danger becomes more serious if the accident takes place along a stretch of motorway and it becomes really serious if the fired vehicle is (or stops) into a tunnel where the means of escaping from the fire effects (including the risk of explosions and of toxic and irritating smokes deriving from the burning of the possible load) are further reduced.

These fires can be set by natural causes (for instance spontaneous combustion of the load), accidental and/or mechanical ones (such as the overheating of the brakes, a malfunction of the lubrication system with falling of the lubrication liquid on the engine, a subsequent fire and so on) and they can "smolder" even for a long time often so violently as any attempt to put them out or keep them under control is useless or belated.

The thermographic system subject of the present invention is an efficacious means to control and prevent fires in road and rail vehicles as not only it does allow to detect fires (which can be put out or kept under control) and/or (at least potentially) situations capable of setting a fire (such as an overheating of the brakes) at the right time but in case of accident and/or fire, it also allows the staff and/or the competent authorities "to monitor" the situation in real time to intervene at the night time and in an effective way in order to avoid (or at least limit) further damages deriving from the accident and/or fire as this system is not "clouded" by fog, darkness, presence of smokes, etc.

SUMMARY OF THE INVENTION

Subject of the present invention is a thermographic system to check and prevent fires in a vehicle comprising the following parts combined between them:

- a plurality of sensors held up by an arch structure and apt to detect the temperature of specific points of the vehicle;
- a logic control unit connected to the sensors and apt to generate an alarm signal if the temperature detected by one or more sensors exceeds a pre-established value.

Preferably, but not necessarily, the sensors are constituted by infrared visual sensors and if the thermographic system is placed near a fixed way, further sensors fitted into the ground allow to keep under control even the lower part of the vehicle.

BRIEF DESCRIPTION OF THE DRAWINGS

Now the invention will be more clearly described with reference to a non-restrictive example of realisation which is shown in the enclosed figures wherein.

DETAILED DESCRIPTION OF THE INVENTION

Now, the thermographic system subject of the present invention will be described with reference to a non-restrictive example of realisation relevant to vehicles in motion on road, motorway and/or in a tunnel without leaving the field of the present invention, this thermographic system can be advantageously used (with eventual changes which are clear for a technician in the field) "To monitor" railway vehicles, planes, boats, etc.

Figure 1:
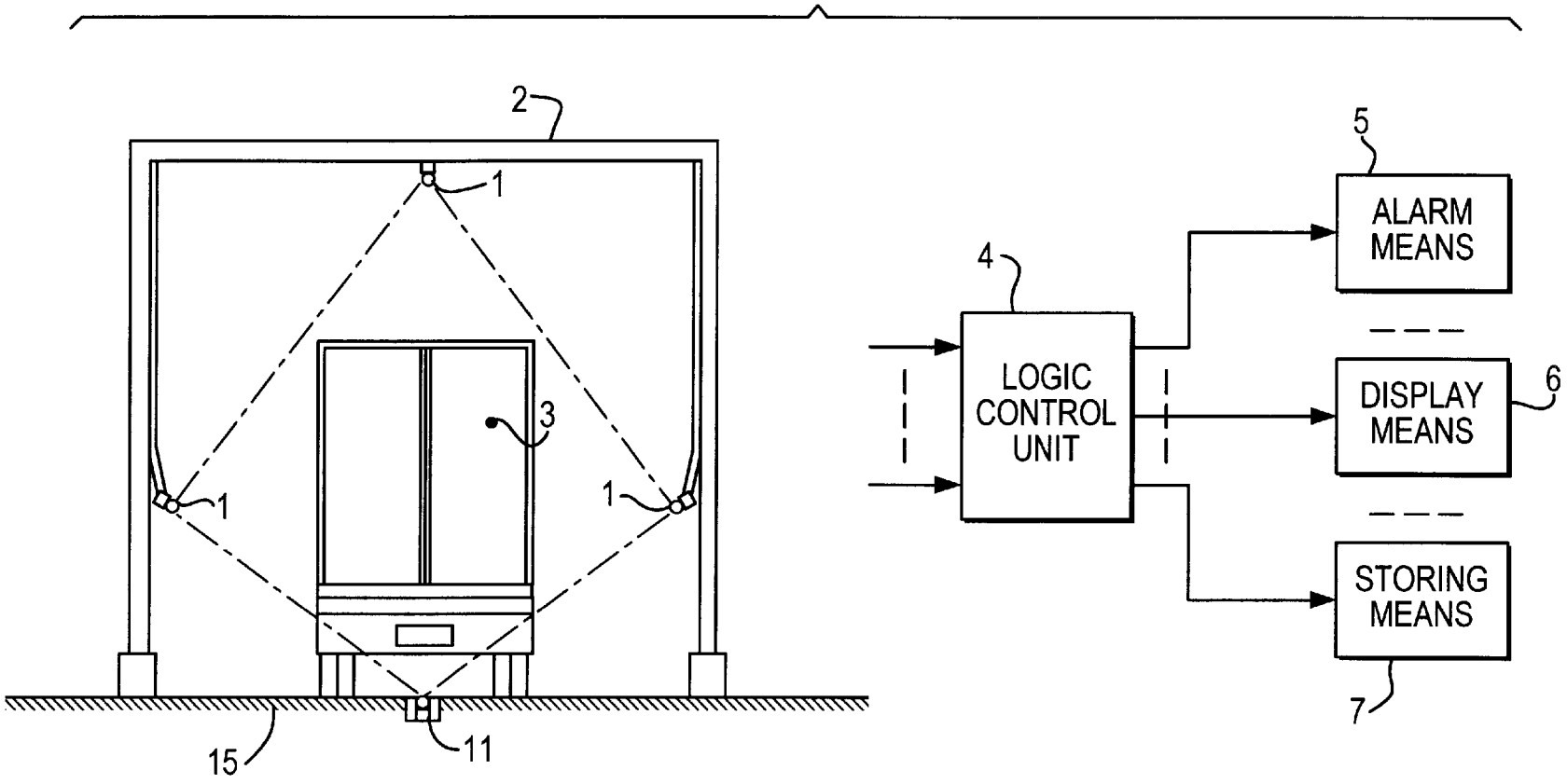
FIG. 1 shows in a schematic way a first example of realisation of a thermographic system carried out according to the present invention.

FIG. 1 shows in a schematic way a thermographic system carried out according to the present invention (apt to monitor vehicles in motion on road or motorway and/or in a tunnel) comprising the following parts combined between them:

- a plurality of sensors 1, mounted on the fixed arch structure 2 and apt to detect the temperature of specific points of the vehicle which is schematically indicated with 3;
- a logic control unit 4 connected to sensors 1 and apt to generate at least an alarm signal (for instance a visual and/or a sound signal) if the temperature detected by at least one of the sensors 1 exceeds a pre-established value; the transmission means connecting the sensors 1 to the logic control unit 4 are known in themselves anyway they are not subject of the present invention, they have been omitted to simplify the graphic representation.

In the example of realization described hereinbelow (which is particularly apt to be mounted near a fixed way such as a tollgate) the thermographic system comprises further sensors (shown in FIG. 1 with 11), fitted into the ground 15 and connected to the logic control unit 4, allowing even the lower part of the vehicle 3 to be kept under control, although these further sensors can be nevertheless omitted without leaving the field of the invention.

Preferably, but not necessarily, sensors 1 are constituted by infrared visual sensors (for instance "Thermacam" sensors produced by Inframetrics) but, without leaving the field of the invention, it is possible to replace the infrared visual sensors with other kinds of sensors corresponding to the above mentioned ones in their functioning; they are not described in the present invention as they are known in themselves.

Preferably, but not necessarily, at least part of the sensors 1 and/or 11 is apt to detect the temperature of some points of the vehicle which are considered (at least potentially) dangerous such as brakes.

Advantageously, the pre-established temperature value changes according to the point of the vehicle 3 which is checked by the at least one sensor (1, 11) which detected the anomalous temperature; in response to the exceeding of the pre-established temperature value the logic control unit 4 generates the at least one alarm signal: as a non-restrictive example, it must be considered that the logic control unit 4 must (or can) consider as a normal one a temperature detected by a sensor (1,11) next to the engine and/or the exhaust pipe which is (relatively) high, while it can (or must) be considered as an anomalous one this temperature (consequently generating an alarm signal) if it has been detected next to a brake or the boot of the vehicle 3.

In the example of realisation described here below a great number of peripheral units including (optical and/or sound) alarm means 5, display means 6 and storing means 7 apt to store the temperatures detected by at least a part of the sensors (1,11) and/or temperatures processed by the logic control unit 4 (at least for a pre-established time).

If wished and/or required, further means apt to connect (or disconnect) the opening of the tollgate turnpike and/or another stop device of the vehicle 3 such as a traffic light can be connected to the logic unit 4.

In order to allow the logic control unit 4 to consider as a normal one or an anomalous one a temperature detected by a sensor (1,11) according to the point of the vehicle wherein such temperature has been detected, in a preferred example of realisation of the present invention, a memory (which is not shown in FIG. 1) where the thermic mappings of the kinds of vehicles which are normally used on road are stored is connected to the logic control unit 4: the logic unit 4 compares the data detected by sensors 1 with the ones mapped in the storage unit and, if necessary, it generates an alarm signal.

If the thermographic system is guarded the operator can check on the image of the vehicle which is shown by the visualisation means 6 if The alarm signal is caused by a real (or at least potential) dangerous situation or if it is caused by a non dangerous accidental event (for instance due to the fact that the vehicle doesn't belong to anyone of the kinds mapped in the storage unit): in this case the operator can disconnect the alarm signal.

The identification of the Kind of checked vehicle by the logic unit 4 is (or can be) made easier by linking to the logic unit 4 one of the known systems which are normally used at tollgates to identify a vehicle class.

If the sensors (1,11) have a "zoom lens" and/or they are adjustable and/or they can anyway be manoeuvred by the logic control unit 4, a thermographic system according to the invention moreover includes (or can include) means (which are not described in the present invention as they are known in themselves) apt to manoeuvre the sensors (1, 11) through the logic control unit 4; the transmission means connecting the sensors (1,11) to the logic control unit 4 are of the two-way kind.

A thermographic system according to the invention (if necessary without the sensors fitted into the ground) can be advantageously mounted at the entrance of a tunnel with the sensors placed in such a way as "to see" the vehicles approaching in due Time that means at such a distance from the tunnel entrance to allow the logic control unit 4 to detect a possible dangerous situation in a vehicle and signal it to a guarded check point in order to connect the means (such as a traffic light) apt to avoid the entrance into the tunnel of the vehicle.

The arch structure 2 can be advantageously constituted by the tunnel extrados area where the sensors 1 are fixed.

A thermographic system according to the invention can be advantageously mounted (preferably at regular distances) on the vault of a tunnel too: in case of accident and/or fire its sensors allow the staff (and the competent authorities) at the check point "to monitor" the situation into the tunnel in real time in order to intervene in an effective way at the right time in order to avoid (or at least limit) further damages deriving from the accident and/or fire as they are not clouded by darkness, presence of smokes, etc.

Even in this case, the arch structure 2 can be advantageously constituted by the extrados of the tunnel where the sensors 1 are fixed.

Figure 2:
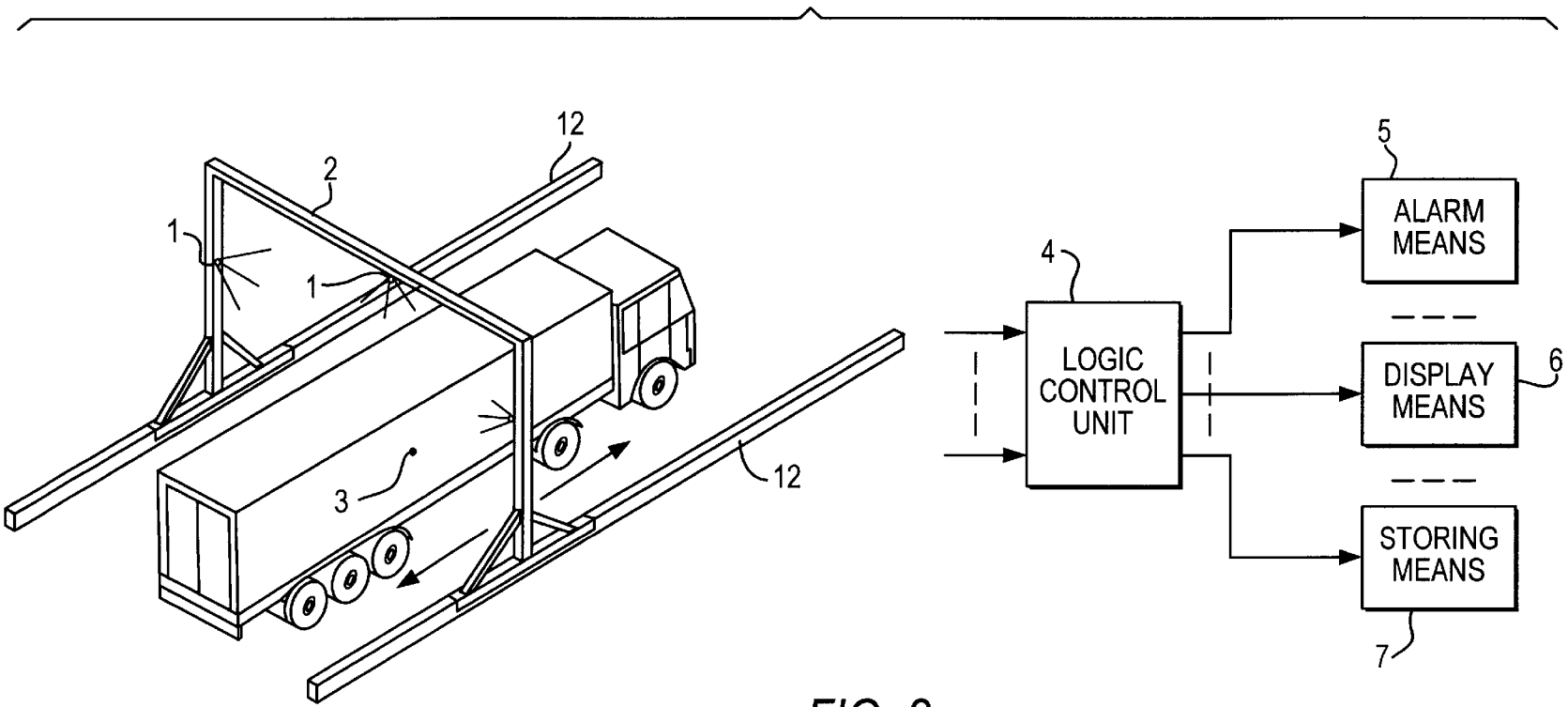
FIG. 2 shows in a schematic way a second example of realisation of a thermographic system carried out according to the present invention.

FIG. 2 shows a second example of realisation of the thermographic system subject of the present invention which is different from the one previously described with reference to FIG. 1 as the arch structure 2 where the sensors 1 are hardly fixed is movable (they are not clearly indicated in FIG. 2 in order to simplify the graphic representation): in the example of realisation shown in FIG. 2, the arch structure 2 runs (in a well known way) along tracks 12.

Figure 3:
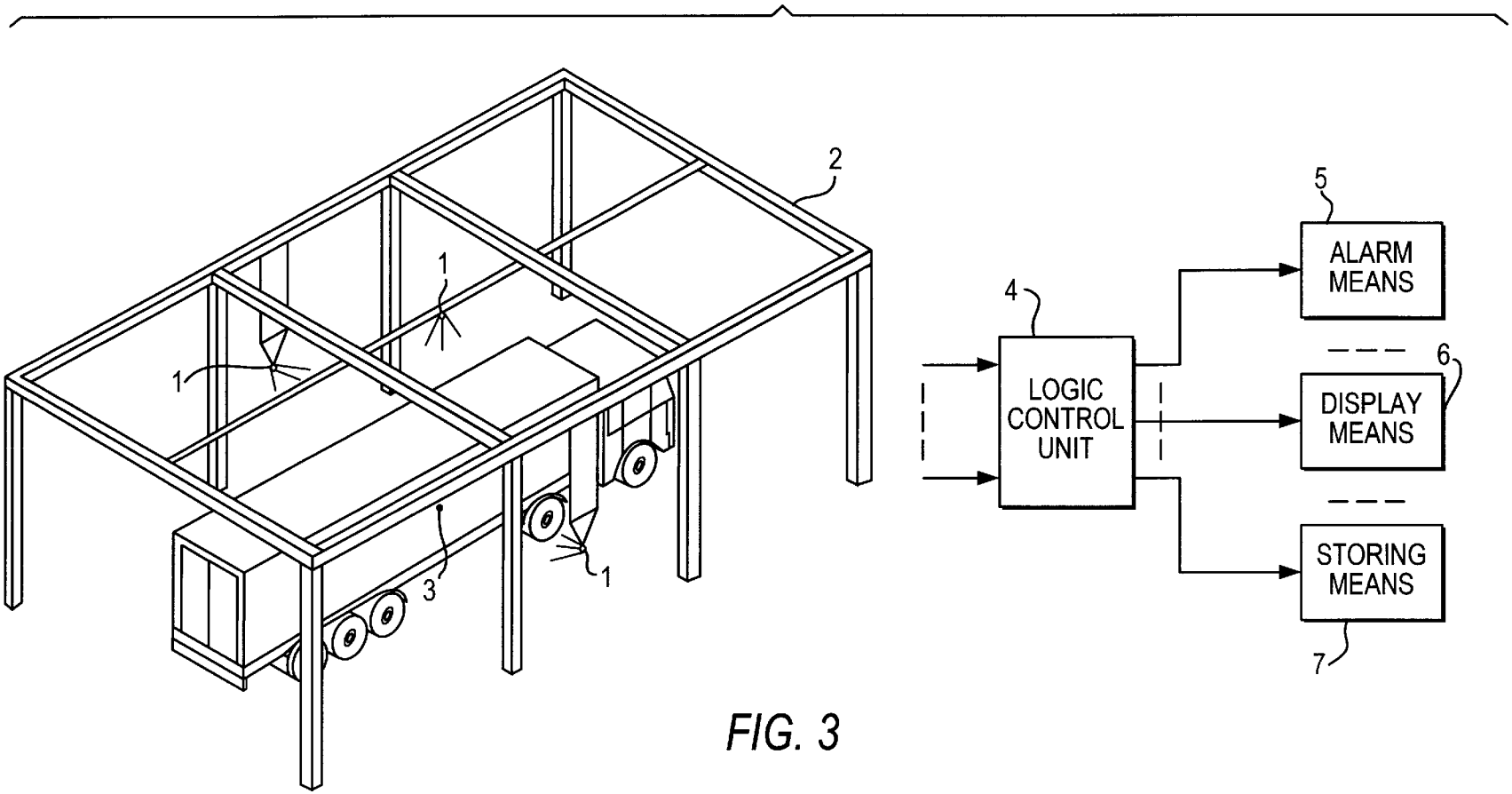
FIG. 3 shows in a schematic way a third example of realisation of a thermographic system carried out according to the present invention.

FIG. 3 shows in a schematic way a third example of realisation of the thermographic system subject of the present invention which is different from the one previously described with reference to FIG. 1 only for the fact that the arch structure 2 is fixed and has an oblong shape and that the sensors 1 (which are not clearly indicated in FIG. 3 in order to simplify the graphic representation) run along the arch structure 2.

A technician can make all the changes and improvements to the thermographic system subject of the present description which are suggested by the usual experience and by the natural evolution of the technique.

What is claimed is:

1. A thermographic system to check and prevent fires in a vehicle wherein said thermographic system comprises at least the following combination of parts:

a plurality of sensors held up by an arch structure mounted, over and above the vehicle, along the path of the vehicle and apt to detect the temperature of specific parts of the upper portion of the vehicle; and a logic control unit connected to said sensors and apt to generate at least an alarm signal if the temperature detected by at least one of the sensors exceeds a preestablished value;

wherein said thermographic system is mounted at the entrance of a tunnel with the sensors placed in such a way to see the vehicles approaching to the tunnel at such a distance with respect to the entrance of the tunnel to allow the logic control unit to detect a dangerous situation in a vehicle and to generate at least an alarm signal to avoid the entrance into the tunnel of the vehicle.

* * * * *